United States Patent [19]

Bobry

[11] Patent Number: 4,943,763

[45] Date of Patent: Jul. 24, 1990

[54] FERRORESONANT TRANSFORMER WITH DUAL OUTPUTS

[75] Inventor: Howard H. Bobry, Edmonds, Wash.

[73] Assignee: Albar, Inc., Lynnwood, Wash.

[21] Appl. No.: 241,889

[22] Filed: Sep. 8, 1988

[51] Int. Cl.[5] ..... G05F 3/06; H01F 21/08

[52] U.S. Cl. ..... 323/309; 336/160; 336/215

[58] Field of Search ..... 323/306, 307, 308, 309, 323/248; 336/155, 160, 165, 212, 214, 215

[56] References Cited

U.S. PATENT DOCUMENTS

| | | | |
|---|---|---|---|
| 1,950,396 | 3/1934 | Boucher | 336/165 X |
| 2,352,073 | 6/1944 | Boucher et al. | 336/165 X |
| 2,512,976 | 6/1950 | Smeltzly | 336/165 X |
| 2,996,656 | 8/1961 | Sola | 336/165 X |
| 3,389,329 | 6/1968 | Quirk et al. | 336/160 X |
| 3,521,152 | 7/1970 | Emerson | 336/165 X |
| 3,686,561 | 8/1972 | Spreadbury | 336/165 X |
| 4,262,245 | 4/1981 | Wendt | 336/160 X |

FOREIGN PATENT DOCUMENTS

| | | | |
|---|---|---|---|
| 861215 | 2/1941 | France | 336/165 |

*Primary Examiner*—Thomas J. Kozma

*Attorney, Agent, or Firm*—Pearne, Gordon, McCoy & Granger

[57] ABSTRACT

A ferroresonant transformer having dual outputs electrically and magnetically isolated from one another. The transformer includes a core, a primary coil on the core adapted to be connected to a source of alternating current, and two pairs of secondary windings located at axially opposite ends of the primary winding. Each of the secondary windings is coupled to the primary through a steel shunt located between the primary winding and the respective secondary winding. Each of the two secondary windings has a resonant winding associated therewith and connected to a ferrocapacitor to produce an inductive coupling. Each of the secondary windings has a pair of output terminals, each of which is connected to a separate load, with the effect that the loads are electrically and magnetically isolated from each other.

1 Claim, 1 Drawing Sheet

FERRORESONANT TRANSFORMER WITH DUAL OUTPUTS

BACKGROUND OF THE INVENTION

This invention relates to ferroresonant transformers such as those used in power regulation, and especially to the use of such ferroresonant transformers as self-regulating power control devices. More particularly, the invention relates to the use of ferroresonant transformers in systems where more than one load is to be powered, and where the loads are preferably electrically and magnetically isolated from one another.

Ferroresonant transformers have been used in many applications, including voltage regulating systems, for several decades. They comprise basically a laminated steel core around which are wound separate primary and secondary windings, with steel shunts placed between the primary and secondary windings. These magnetic shunts between the primary and secondary windings create an inductive coupling between the primary and secondary circuits. Integral with the secondary winding is a resonant winding coupled to a capacitor, sometimes called a "ferrocapacitor." The capacitor, or ferroresonating capacitor, shunts the saturating inductor or winding, and is usually near resonance with the linear inductance.

The combination of the resonant capacitor and the inductive coupling produced by the shunts creates a resonant circuit. The gain of this resonant circuit drives the magnetic flux in a portion of the core within the secondary winding to saturation. That is to say, this portion of the core cannot be driven to a higher flux density despite changes in the input voltage or output load. Since voltage induced in the secondary winding is proportional to flux density, the voltage at the terminals of the secondary winding (the load voltage) remains constant.

The ferroresonant transformer thus functions to provide a constant output voltage despite changes in output load or input voltage. In addition, the saturation of the secondary section of the core causes the output waveform to be nearly a square wave rather than a sine wave. This is advantageous where the output is rectified and filtered in order to provide a D.C. power supply.

An additional advantage of the ferroresonant transformer is that the inductive coupling of the primary and secondary circuits makes the transformer inherently current-limited. If the secondary is shorted, the primary current is limited to safe levels because there is, in effect, a substantial inductance between the primary and secondary circuits.

There are numerous applications for ferroresonant transformers where multiple loads are to be powered, and it is desired to provide redundancy such that the short circuit of load will affect the others. This is conventionally accomplished by using multiple transformers.

An example of this is in cable television applications, where feroresonant power supplies are used to provide 60 volts A.C. on the distribution cable to drive amplifiers and other components. It is desirable to isolate sections of cable from one another so that a fault on one section which shorts the cable will not affect adjoining sections of the cable.

The solution, as indicated above, has been to use two or more ferroresonant transformers to achieve the desired electrical and magnetic isolation between the different sections. This is a cumbersome and costly arrangement, and is particularly undesirable where weight constraints are in the picture.

The device of the present invention reduces the difficulties indicated above, and affords other features and advantages heretofore not obtainable.

SUMMARY OF THE INVENTION

It is among the objects of the present invention to provide a ferroresonant transformer with two outputs that are electrically and magnetically isolated from each other.

Another object is to provide a ferroresonant transformer with multiple outputs wherein a short circuit across the terminal of one output will have no effect on any other output.

The above objects and advantages are achieved with the ferroresonant transformer design of the present invention wherein, as conventional components, there are a ferromagnetic core and a primary winding on the core adapted to be connected to a source of alternating current. In accordance with the invention, there is a first secondary winding section on the core coupled to a first load and a first magnetic shunt means disposed between the primary winding and the first secondary winding section. A first resonant winding connected to a ferrocapacitor is coupled to the first secondary winding. There is also provided a secondary winding section on the core coupled to a second load independent of the first load. A second magnetic shunt means is disposed between the primary winding and the second secondary winding section, and a second resonant winding connected to a ferrocapacitor is coupled to the second secondary winding section. Accordingly, the first load is electrically and magnetically isolated from the second load, and a short circuit across either load will have no effect on the other load.

BRIEF DESCRIPTION OF THE DRAWINGS

The FIGURE in the drawings is a circuit diagram illustrating a typical ferroresonant transformer design embodying the present invention.

DESCRIPTION OF THE PREFERRED EMBODIMENT

Figure 1:
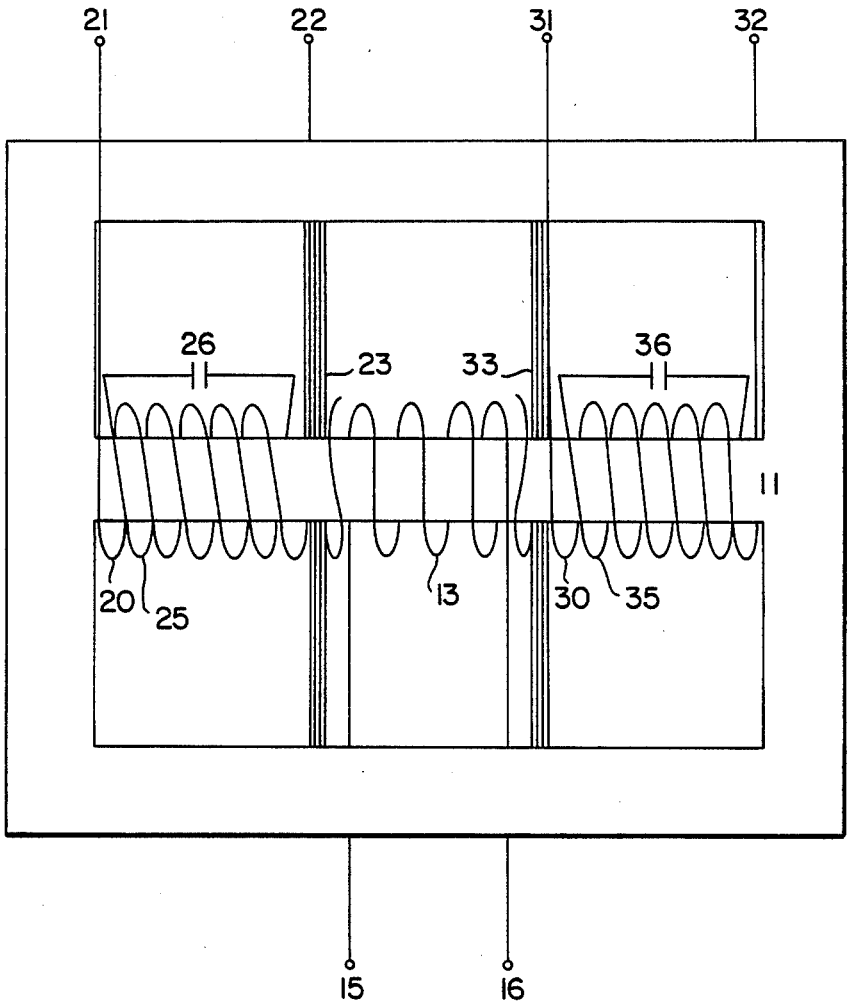

Referring to FIG. 1 there is shown a ferroresonant transformer with dual outputs electrically and magnetically isolated from one another. The transformer includes a ferromagnetic core 11 of conventional design and a primary winding 13 with input terminals 15 and 16. The transformer also includes a first secondary winding 20 and a second secondary winding 30, the windings 20 and 30 being located at opposite axial ends of the primary winding 13. The first secondary winding 20 has output terminals 21 and 22, and is inductively coupled to the primary winding 13 by a magnetic shunt 23.

The second secondary winding 30 has a pair of output terminals 31 and 32, and is inductively coupled to the primary winding 13 through a magnetic shunt 33.

The shunts 23 and 33 form a highly reactant shunt between the primary portion of the transformer and the respective secondary winding, whereby the magnetic fluxes generated by the primary and each secondary winding may link themselves to the exclusion of the other winding, thereby making the transformer one of a high reactance type.

Associated with the first secondary winding 20 is a first resonant winding 25 connected to a first ferrocapacitor 26.

Likewise, the second secondary winding 30 has a second resonant winding 35 associated therewith connected to a second ferrocapacitor 36.

Operation

In accordance with the standard operation of a ferroresonant transformer, when an input voltage is applied across the terminals 15 and 16, the result is that the magnetic shunts 23 and 33 between the primary winding and secondary windings 20 and 30 simultaneously create an inductive coupling between the primary winding 13 and the first secondary winding 20 and between the primary winding 13 and the second secondary winding 30. The first and second resonant windings 25 and 35, in combination with the respective resonant capacitors 26 and 36, create respective resonant circuits. The gain of the respective resonant circuits drives the magnetic flux in the portion of the core within the respective secondary winding to saturation. That is, this portion of the core cannot be driven to a higher flux density despite changes in input voltage or output load. Because the voltages induced in the secondary windings 20 and 30 are proportional to the flux density in the core, the voltages at the terminals of the secondary windings 20 and 30 remain constant. The ferroresonant transformer thus functions to provide a constant output voltage despite changes in output load or input voltage. In addition, the saturation of the secondary sections of the core causes the respective output waveforms to be nearly a square wave rather than a sine wave. This is advantageous where the output is rectified and filtered in order to provide a D.C. power supply.

The particular advantage of the ferroresonant transformer shown and described is that each of the two secondary windings 20 and 30 is inductively coupled to the single primary winding through a set of magnetic shunts, but there is very poor inductive coupling between one secondary winding and the other. Accordingly, this transformer functions as if it were two separate ferroresonant transformers, with the advantage of lower cost and smaller physical size.

While the invention has been shown and described with respect to a specific embodiment thereof, this is intended for the purpose of illustration rather than limitation, and other variations and modifications of the specific device herein shown and described will be apparent to those skilled in the art all within the intended spirit and scope of the invention. Accordingly, the patent is not to be limited in scope and effect to the specific embodiment herein shown and described, nor in any other way that is inconsistent with the extent to which the progress in the art has been advanced by the invention.

What is claimed is:

1. In a ferroresonant transformer having a core and a primary winding on said core adapted to be connected to a source of alternating current, the improvement which comprises:

a first secondary winding section on said core coupled to a first load;

first magnetic shunt means disposed between said primary winding and said first secondary winding section;

a first resonant winding connected to a ferrocapacitor and coupled to said first secondary winding section to regulate the voltage level supplied to said first load;

a second secondary winding section on said core coupled to a second load;

second magnetic shunt means disposed between said primary winding and said second secondary winding section; and a second resonant winding connected to a ferrocapacitor and coupled to said secondary winding section to regulate the voltage level supplied to said second load;

whereby said first load is electrically and magnetically isolated from said second load.

* * * * *